United States Patent [19]

Chevalier

[11] 4,036,370

[45] July 19, 1977

[54] GOODS STOWAGE UNIT

[76] Inventor: Alfred Eugène Chevalier, Quartier Notre Dame, 83260 La Crau, France

[21] Appl. No.: 670,564

[22] Filed: Mar. 25, 1976

[30] Foreign Application Priority Data

Feb. 2, 1976 France ..... 76.02803

[51] Int. Cl.[2] ..... A47F 5/00

[52] U.S. Cl. ..... 211/162; 211/46

[58] Field of Search ..... 211/162, 94, 94.5, 46; 49/425, 426; 160/89, 90, 91; 16/100, 91

[56] References Cited

U.S. PATENT DOCUMENTS

| | | | |
|---|---|---|---|
| 431,012 | 6/1890 | Smythe | 49/425 |
| 1,835,744 | 12/1931 | Austin | 211/46 |
| 2,677,154 | 5/1954 | Agle | 49/425 |
| 3,185,309 | 5/1965 | Radek | 211/94 X |
| 3,732,633 | 5/1973 | Margolis et al. | 211/162 |
| 3,883,004 | 5/1975 | Slaga | 211/162 |
| 3,912,086 | 10/1975 | de Bruyn | 211/162 |

*Primary Examiner*—Roy D. Frazier
*Assistant Examiner*—Robert W. Gibson, Jr.

[57] ABSTRACT

The invention relates to a goods stowage unit comprising a framework, a set of vertical parallel storage elements mounted between two parallel vertical reference planes spaced from one another, each storage element extending obliquely with respect to said reference planes. Part of the storage elements are stationary, the other being movable in their own planes along guides provided in the framework. The unit allows the goods to be stored, handled, distributed and displayed in an integrated form.

3 Claims, 4 Drawing Figures

GOODS STOWAGE UNIT

The present invention has for its object a goods stowage unit, more particularly a unit for storing therein, on the very spot of its distribution, a group, set or number of goods compactly gathered together within a reduced space, with minimum time of access and greatly facilitated handling.

The problem of goods storage in numerous trades involves restraints from the point of view of both the available space and the handling required for example in the case of relatively bulky goods, which, in any case, does not allow the whole range of goods offered for sale to be displayed simultaneously. In the case of supermarkets or large stores, these problems are attended by a problem of manpower, i.e. the number of persons, salesmen or salewomen assigned to a department may depend, according to the type of department, on the mode of display and the handling necessary for each selling operation.

The invention aims at solving all these problems simultaneously by means of a stowage unit allowing the goods to be stored, handled, distributed and displayed in an integrated form requiring minimum handling and minimum manpower owing to the means time necessary for each selling operation being considerably reduced.

The invention therefore provides a goods stowage unit of the type comprising a framework, as set of vertical parallel storage elements mounted between two vertical parallel reference planes spaced from one another, each said storage element extending between the said reference planes, characterized in that each storage element extends obliquely or slantwise with respect to the said reference planes.

Thus, according to one feature of the invention, the depth of each storage element is smaller than its width.

According to another feature of the invention, part of the storage elements are movable in their own planes, thus permitting easy access to the goods stored in the said storage elements and allowing, in some cases, any transfer of the goods to a place of distribution to be avoided.

According to another feature of the invention, the framework of the unit is constituted by a self-supporting structure comprising a base, and a false-ceiling rigidly connected with one another by stationary storage elements.

According to another feature of the invention, the access to the goods in each storage element being obtained by displacing the latter in its own plane, allows the distance separating two storage elements to be reduced to a minimum.

Figure 1:
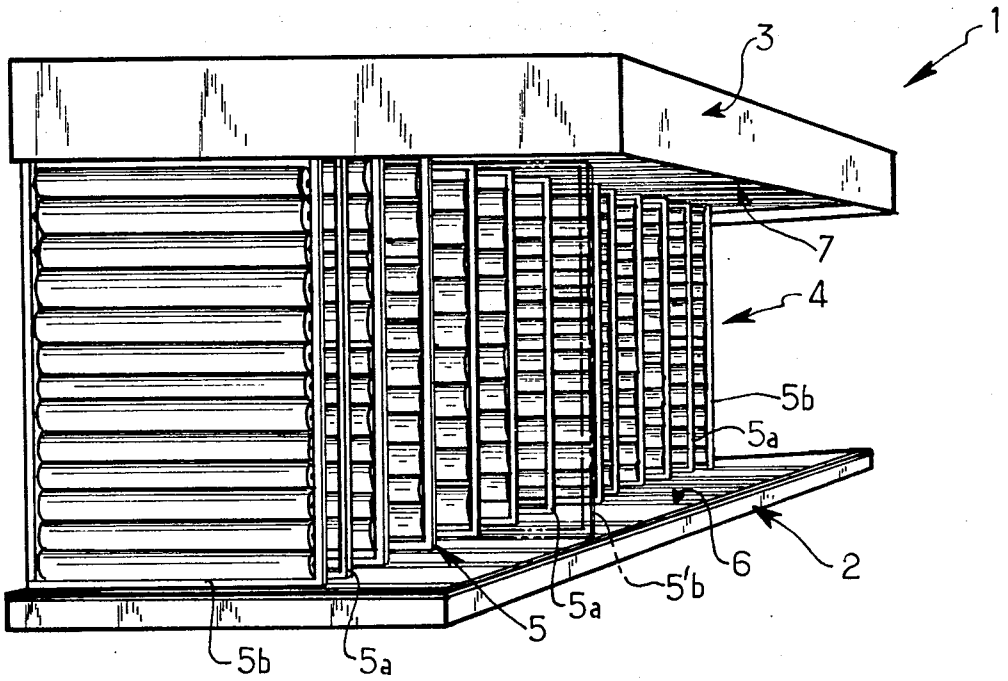
Figure 2:
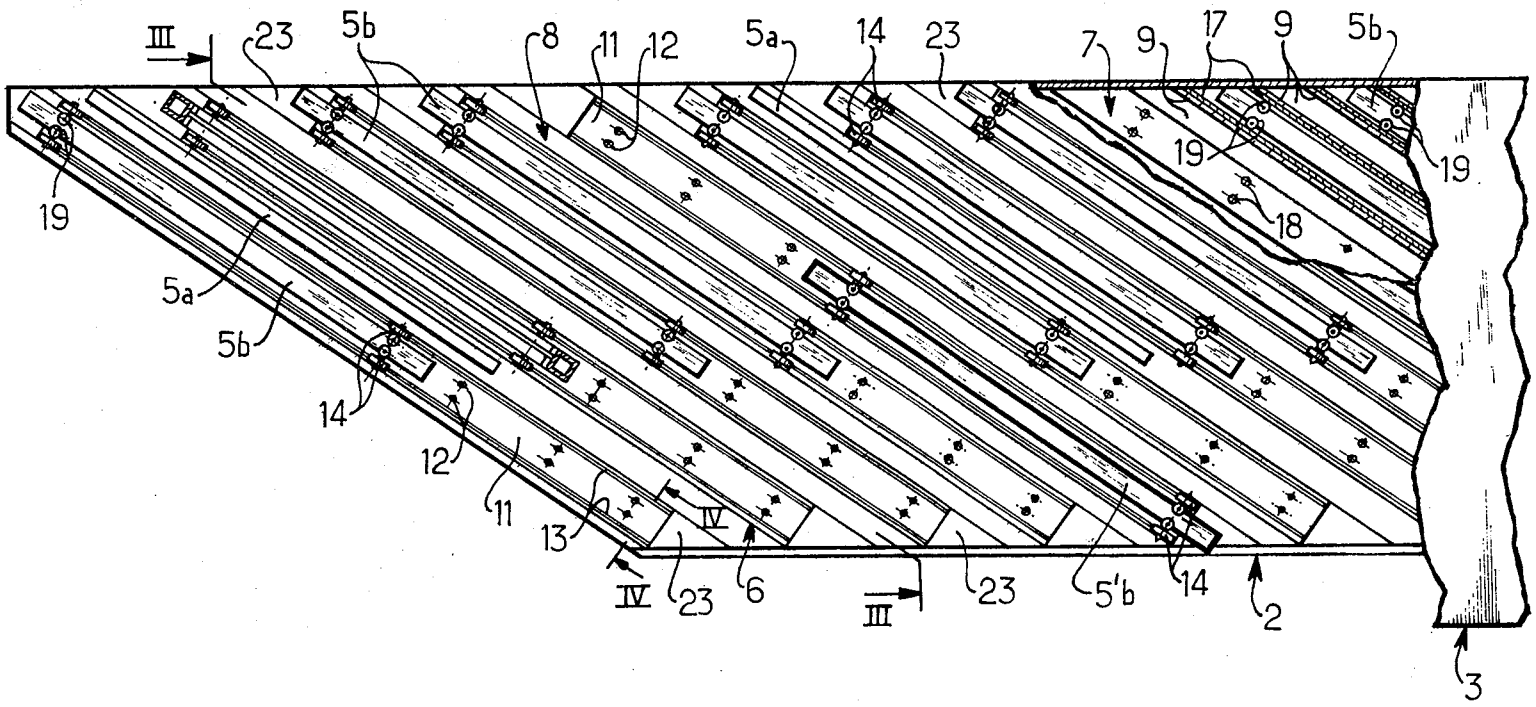
Figure 4:
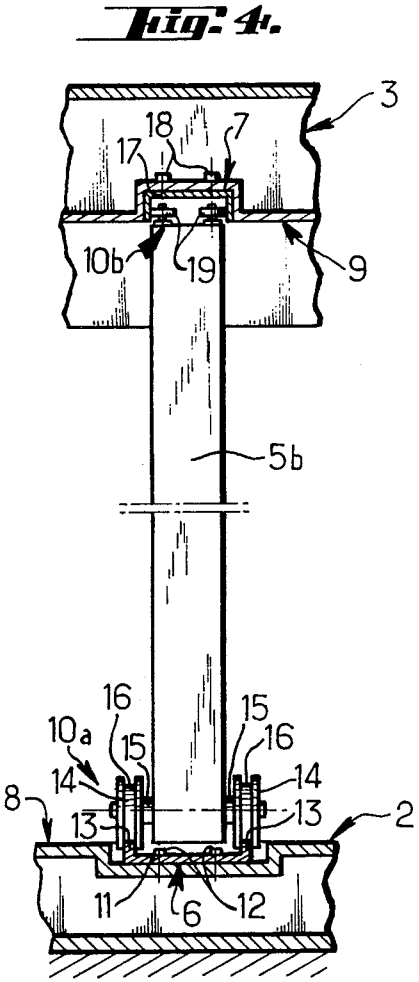
Figure 3:
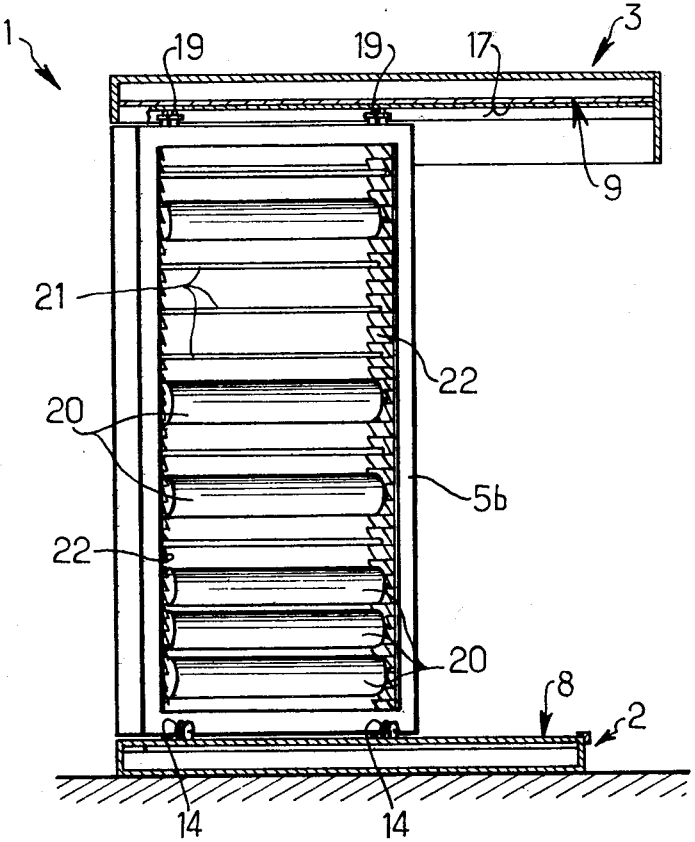

Other features, advantages and details will appear more clearly from the following explanatory description made with reference to the appended drawings given solely by way of example and wherein:

FIG. 1 is a perspective view of a stowage unit according to a preferred form of embodiment of the invention, FIG. 2 is a top view of the stowage unit according to the invention, with the false-ceiling removed, FIG. 3 is a sectional view upon III—III of FIG. 2, and FIG. 4 is a sectional view upon IV—IV of FIG. 2.

The stowage unit according to the invention therefore allows, in certain applications, simultaneous performance of the functions of storage, handling, distribution and display of the products or goods stored in the various storage elements within a minimum space.

In the preferred example illustrated in the Figures, the unit 1 comprises a framework constituted by a base 2, a false-ceiling 3 and a set of storage elements 4 arranged vertically between the base 2 and the false-ceiling 3.

Referring to FIG. 1, the set of storage elements 4 consists of a set of frames or panels 5 including a series of stationary or supporting panels **5*a* serving to rigidly interconnect the base 2 and the false-ceiling 3, and a series of panels or frames 5*b* which are movable in their own respective planes through the medium of guides 6, 7 machined in the base 2 and the false-ceiling 3, respectively. In FIG. 1, an empty panel 5'*b*** is shown drawn, i.e. emerging from the whole set of panels, thus allowing free access to the goods contained therein or supported thereby.

Referring to FIGS. 2 and 4, the means allowing the movable panels **5*b* to be displaced at the level of the base 2 and of the false-ceiling 3** are shown more in detail.

The base 2 constituted for example by tubular elements has a horizontal surface 8 forming a false-floor constituted for example by a steel plate previously pressed so as to define all along the base 2 a set of mutually parallel and regularly spaced grooves 6 forming a predetermined angle with the longitudinal axis of the said base. At the level of the lower surface 9 of the false-ceiling 3 opposite the false-floor 8 are machined a set of grooves 7, by pressing for example a steel plate forming the lower surface of the false-ceiling 3, which grooves 7 are equal in number to the grooves 6 and in mutually confronting relationship thereto.

Between each groove 6, 7 of the base 2 and of the false-ceiling 3 is mounted either a stationary supporting panel **5*a* or a movable panel 5*b*. In FIG. 4 is shown how a panel 5*b* is mounted movably in its own plane through the medium of two sets of rollers 10*a*, 10*b* associated with each movable panel 5*b* and the corresponding guides 6, 7 of the base 2 and the false-ceiling 3**.

In each groove 6 of the base 2 and over substantially its whole length is accommodated a channel bar 11, the pad or web of which is rigidly secured to the false-floor 8 by means of screws 12. The dimensions of the channel bar 11 are such that its section has dimensions smaller than the section of the groove 6, and the length of the flanges 13 is such that the free ends of the latter are substantially at the same level as the false-floor 8.

At the bottom of each storage element or movable panel **5*b* are mounted, on either side of the latter and towards each of its ends, two sets of running rollers 14 interconnected by a shaft 15 and adapted to roll on the free ends of the channel bar 11 through the medium of slots 16**.

Towards the upper end of the movable frames or panels **5*b*, at the level of each guide 7, is provided a second set of rollers 10*b* mounted on the end surface of each movable panel 5*b*, the guiding paths being defined by the parallel faces of each groove 7. In some cases, this groove may be advantageously covered with a lining 17 according to the materials used, the said lining being secured at the bottom of the groove through the medium of screws 18. The guiding rollers 19 are four in number, i.e. two towards each end of each panel 5*b*, and are mounted in perpendicular relationship to the lower rollers 10*a***.

Referring to FIG. 3 illustrating a movable panel **5*b*, there is shown a mode of storage of a group or a number of horizontal rolls or cylinders 20 supported by rods 21, themselves supported at their ends by toothed bars or racks 22 arranged along both uprights of the panel 5***b*, respectively. The rolls 20 may be for example rolls of fabric, and the presence of the toothed bars 22 allows rolls of different diameters to be stored in the said panel.

As appears from FIG. 3, it is not necessary that the dimensions of the base 2 be exactly the same as those of the false-ceiling 3. In the example illustrated, the dimensions of the false-ceiling 3 are larger than those of the base 2, thus allowing a device for illuminating the whole set of panels to be advantageously accommodated therein.

As can be seen in FIG. 2, abutment or stop means 23 are provided to limit the displacement of the movable panels 5*b* with respect to the base 2, the said abutment means corresponding to maximum clearance of the movable panels 5*b*.

It is clear, although not shown, that the stationary panels serving to rigidly interconnect the base 2 and the false-ceiling 3 are not provided with rollers and are for example welded or screwed at their end surface opposite the base 2 and the false-ceiling 3, respectively.

The whole set of panels or frames 5 forming storage elements are provided, in the example illustrated, with rolls of fabric, and the perspective view of FIG. 1 illustrates the fact that all the rolls of the panels 5 for a definite position of an observer are visible to the latter, thus greatly facilitating the customers' choice. After selecting the type of rolls, the salesman for example through the medium of a handle (not shown) draws the corresponding movable frame so as to almost completely clear it from the whole set of frames, and he can easily unroll a certain length of fabric without having to withdraw the roll from the frame. To this end, there can be provided, for example, a graduation in meters along the uprights of the frame.

By way of example, in order to better illustrate the saving of space as compared with frames arranged in perpendicular relationship to the longitudinal axis of the base, a few examples are give hereinafter.

For a movable frame supporting rolls 1.50 m wide, the total width of the frame is about 1.68 m, and for an angle of inclination of 45° the base must have a width of 2 m maximum in order to entirely cler the rolls supported by the panel, whereas if the angle of inclination were 90° the base would have to be twice as wide as the panel, i.e. 3.36 m wide. This example clearly shows the saving of space allowed by such a stowage unit.

Of course, the width of the base varies according to the degree of inclination given to the various panels.

In the example illustrated, the stationary and movable panels support rolls, but there can be contemplated another type of support, such as drawers which may find a particular application for example in drugstores.

The rigid connection between the base 2 and the false-ceiling 3 through the medium of stationary panels allows a stowage unit to be designed of practically undetermined length, requiring only a floor bearing area.

Of course, the invention is by no means limited to the form of embodiment described herein which has been given by way of illustrative example only. In particular, it comprises all the means constituting technical equivalents of the means described as well as their combinations, if same are carried out according to its gist and used within its scope as defined by the appended claims.

What is claimed is:

1. Goods stowage unit of the type comprising a framework having a base and a false-ceiling substantially parallel with the said base and rigidly connected to the latter, a set of vertical parallel storage elements mounted between and extended obliquely with respect to said base and said false-ceiling, said base having a set of parallel grooves of pressed steel sheet, in each groove is accommodated, over substantially the whole length of said groove, a channel bar with flanges, grooved rollers on opposite sides of some of said storage elements and cooperating with said flanges, the free ends of said flanges being substantially flush with the upper surface of said base and defining a rolling path for said rollers.

2. Stowage unit according to claim 1, wherein the lower surface of said false-ceiling comprises pressed auxiliary grooves equal in number to the first-mentioned grooves and having lateral surfaces forming a guiding path for rollers provided on the upper end surfaces of said storage elements.

3. Stowage unit according to claim 2, wherein the remaining storage elements are stationary for forming the rigid connection between the said base and the said false ceiling.

* * * * *